US006068270A

United States Patent [19]

Kim

[11] Patent Number: 6,068,270

[45] Date of Patent: May 30, 2000

[54] DETACHABLE CART FOR CARRYING GOLF BAG

[75] Inventor: Jung Han Kim, Seoul, Rep. of Korea

[73] Assignee: Korea Sports Co., Ltd., Seoul, Rep. of Korea

[21] Appl. No.: 09/167,881

[22] Filed: Oct. 7, 1998

[30] Foreign Application Priority Data

Aug. 13, 1998 [KR] Rep. of Korea ..... 98-32833

[51] Int. Cl.[7] ..... B62D 21/14

[52] U.S. Cl. ..... 280/43.1; 280/651; 280/652; 280/655; 280/646; 280/47.26; 280/DIG. 6

[58] Field of Search ..... 280/DIG. 6, 646, 280/652, 655, 651, 47.26, 43.1

[56] References Cited

U.S. PATENT DOCUMENTS

| | | | |
|---|---|---|---|
| 2,676,710 | 4/1954 | Williamson . | |
| 2,704,673 | 3/1955 | Bower . | |
| 2,728,581 | 12/1955 | Goebert et al. . | |
| 2,772,890 | 12/1956 | Gastright . | |
| 2,774,403 | 12/1956 | Williamson . | |
| 3,079,166 | 2/1963 | Abgarian . | |
| 3,489,426 | 1/1970 | Bond . | |
| 4,262,928 | 4/1981 | Leitzel | 280/DIG. 6 X |
| 4,474,388 | 10/1984 | Wagner | 280/646 |
| 4,767,001 | 8/1988 | Kim | 280/DIG. 6 X |
| 5,451,072 | 9/1995 | Weng | 280/652 X |
| 5,967,543 | 4/1999 | Taylor | 280/DIG. 6 X |

*Primary Examiner*—Lanna Mai
*Assistant Examiner*—Toan To
*Attorney, Agent, or Firm*—Snell & Wilmer L.L.P.

[57] ABSTRACT

A cart for carrying a golf bag is disclosed, comprising, one or two brackets 100 installed in a golf bag 1; a pair of insertion plates 200 detachably installed in the bracket(s) 100; a pair of bearing parts 300 installed in each of the insertion plates 200, each of the bearing parts 300 having a first bearing 310 and two second bearings 320, the second bearings 320 being located in both sides of the first bearing 310 at suitable intervals (T) and each having at least two keeping grooves 323 in the circumference of shaft holes 322 in the inside surfaces 321 thereof, two pairs of shafts 400 each having at least one keeping protrusion 411 which is selectively inserted in the keeping grooves 323 to limit the rotation of the shafts 400 selectively, each of the shafts 400 being rotatably supported between the first bearing 310 and each of the second bearings 320; and a pair of leg parts 500 each having a wheel 510 and at least one V-shaped leg 520 whose branched upper ends are pivotally connected to each of the shafts 400 and whose lower ends are connected to the wheels 510.

5 Claims, 5 Drawing Sheets

DETACHABLE CART FOR CARRYING GOLF BAG

BACKGROUND OF THE INVENTION

This invention is related to a golf bag cart, and in particular, to a detachable cart for carrying a golf bag.

Because a conventional golf bag is carried on one's shoulder or in one's hand, golfers usually playing with walking a pretty long distance in a broad golf course have found difficulties in carrying the golf bag. Most golfers use a separate cart or are accompanied with a caddie for carrying a golf bag; however, it is still burdensome to the golfers to use the cart because it is heavy and bulky in itself.

Such being the case, a golf bag having a cart has been developed. But the prior art cart applied to the golf bag is unhandy to adjust the angle of the cart about the golf bag and the cost of production is very high, because it is structurally complicated and employs a good many of parts. In addition, because the prior art cart is mounted in the center of right and left sides of the periphery of the golf bag, the golf bag has a tendency to droop because of its weight, and thus the connection part of the golf bag and the cart has open been ripped.

SUMMARY OF THE INVENTION

In accordance with the present invention, there is provided a detachable cart which is constructed in a golf bag. The cart comprises one or two brackets, a pair of insertion plates, a pair of bearing parts, two pairs of shafts and a pair of leg parts.

The one or two brackets are attached to the golf bag and each of the insertion plates is detachably inserted in guide grooves which are formed in the bracket(s).

Each of the bearing parts is installed in each of the insertion plates and it has a first bearing and a pair of second bearings. The second bearings are located in both sides of the first bearing at suitable intervals and each have at least two keeping grooves in the circumference of shaft holes in the inside surfaces thereof.

Each of the shafts is rotatably supported between the first bearing and each of the second bearings and has at least one keeping protrusion which is selectively inserted in the keeping grooves, thereby selectively preventing the rotation of the shafts.

Each of the leg parts has a wheel and at least one V-shaped leg whose branched upper ends are pivotally connected to each of the shafts and whose lower ends are connected to the wheel, whereby the leg parts are swung up and down together with rotation of the shafts.

BRIEF DESCRIPTION OF THE DRAWINGS

The nature and mode of operation of preferred embodiments of the present invention will now be more fully described in the following detailed description, taken with. the accompanying drawings wherein.

DETAILED DESCRIPTION OF THE PREFERRED EMBODIMENTS

Figure 1:
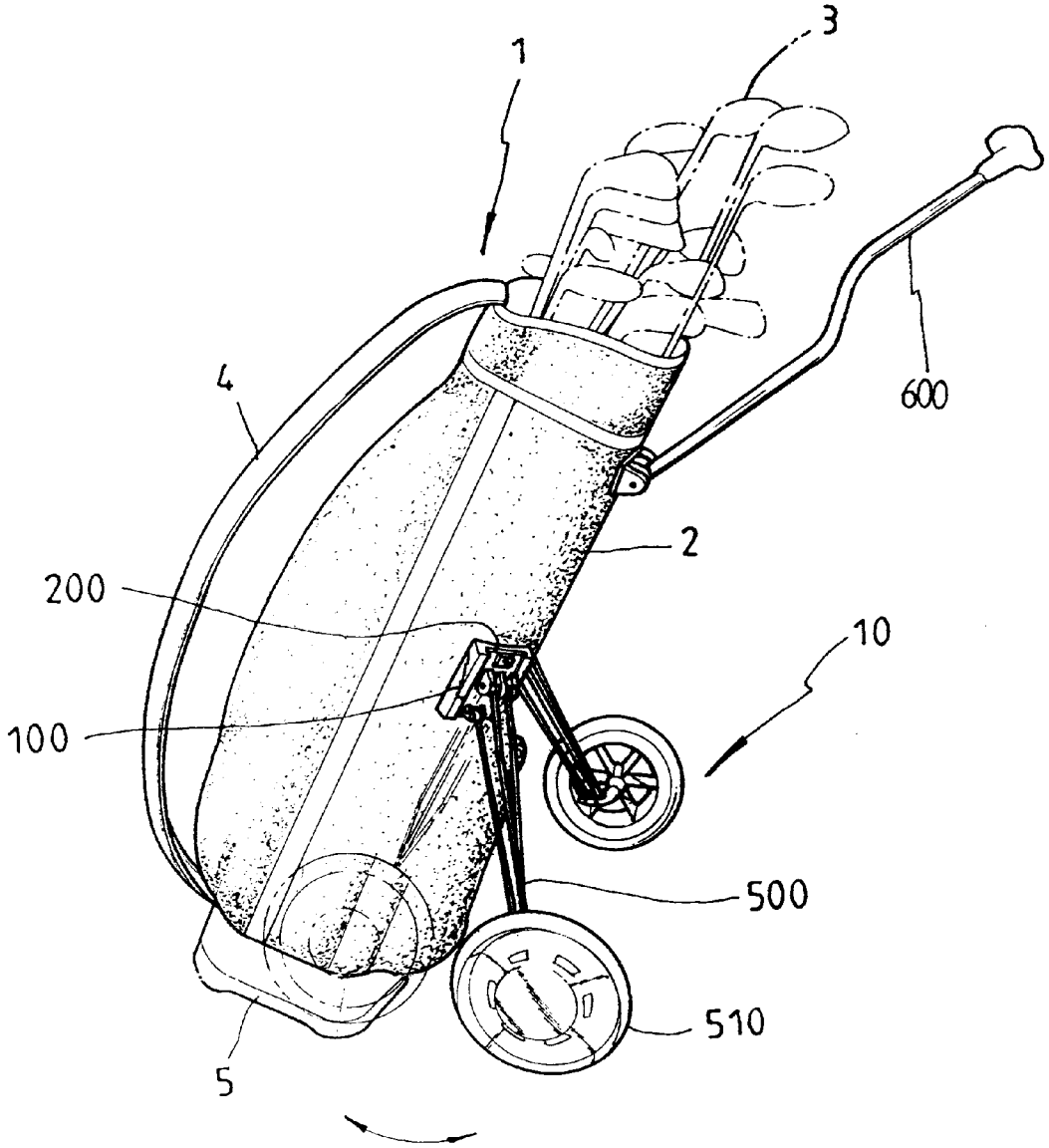
FIG. 1 is a perspective view of a golf bag having a cart in accordance with the present invention.

An exemplary embodiment of a cart in accordance with the present invention is illustrated in FIGS. 1 to 5. The cart 10 is installed in the golf bag 1 to be detachable, which is composed of a pair of brackets 100, a pair of insertion plates 200, a pair of bearing parts 300, two pairs of shafts 400 and a pair of leg parts 500.

Figure 2:
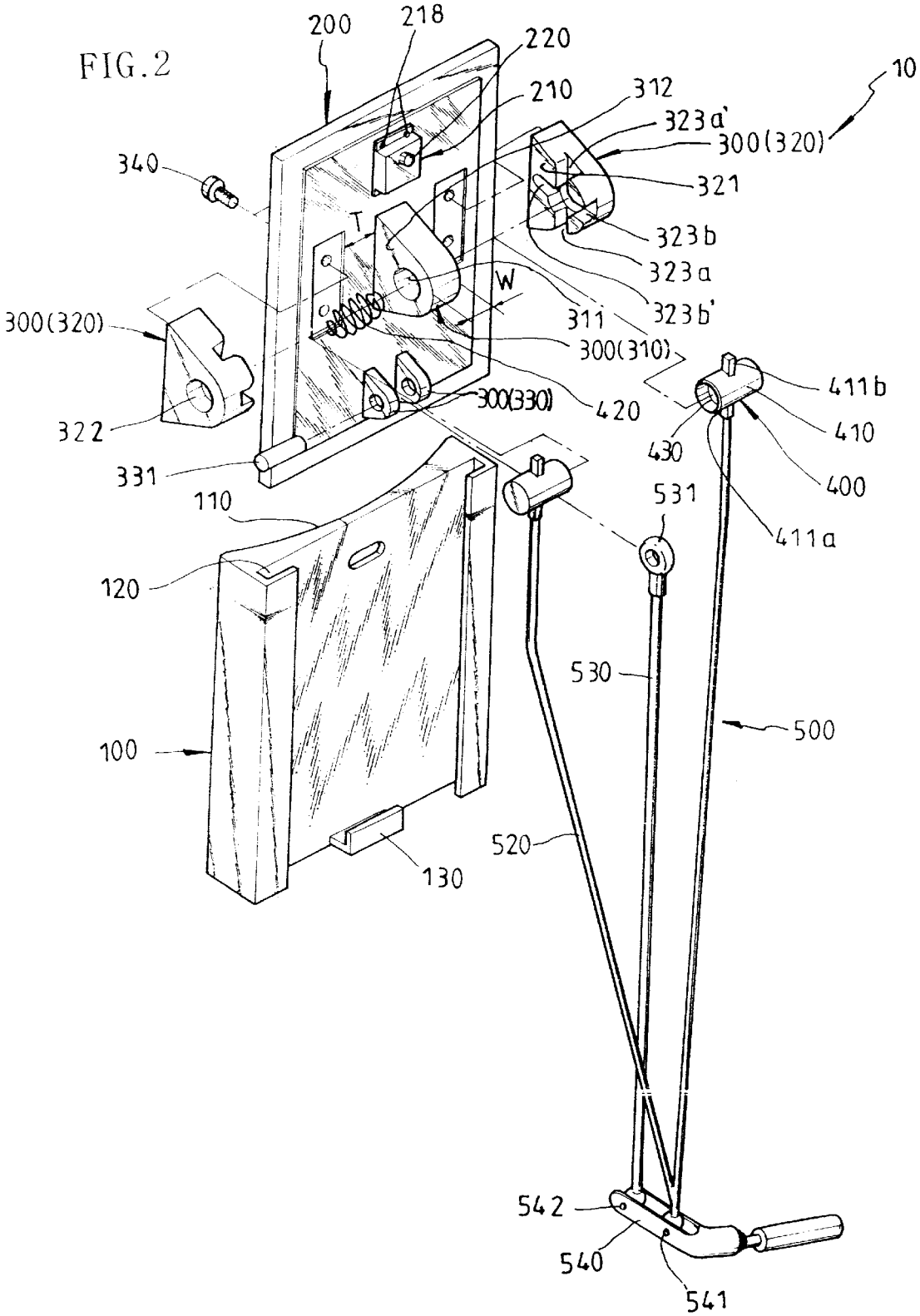
FIG. 2 is a exploded perspective view of a cart in accordance with the present invention.

As shown in FIGS. 1 and 2, the brackets 100 are plate-shaped members to equip the golf bag 1 with the insertion plates 200 as a detachable type. Each of the brackets 100 can be made up to include a contact surface 110 having the shape corresponding to the outer circumferential surface 2 of the golf bag 1, a guide groove 120 where the insertion plate 200 is inserted, and a stopper 130 formed at the lower part of the guide groove 120 to prevent the insertion plate 200 from being taken off. The brackets 100 are tightly attached to the outer circumferential surface 2 opposite to a strap 4 for carrying the golf bag 1 on one's shoulder by rivets or bolts(not shown).

The bracket 100 can be composed of two separate members each having one guide groove 120 so that each of the insertion plates 200 can be inserted in each of the guide grooves 120, as shown in FIGS. 1 and 2. Also, the bracket 100 can be made up of a single member having two guide grooves 120 so that each of insertion plates 200 can be inserted in each of the guide grooves 120 of the single member(not shown).

As illustrated in FIG. 2, the insertion plates 200 are plates in which the bearing parts 300 as described hereinafter are each installed, and they are installed in the bracket, 100 to be detachable by inserting them in the guide grooves 120 until they are trapped in the stopper 130.

Figure 3:
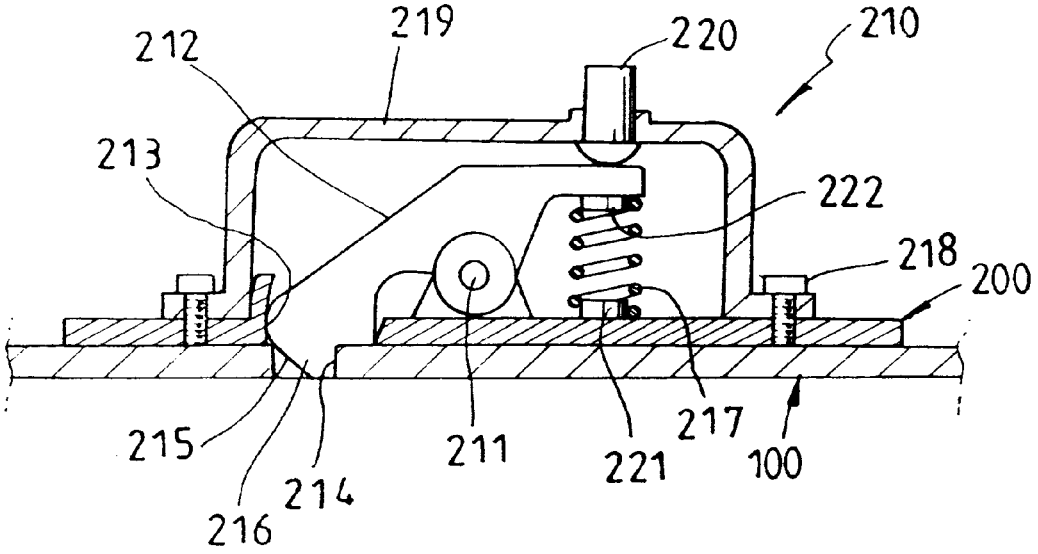
FIG. 3 is a sectional view at line 3—3 of FIG. 2, showing a locking device applied to a cart in accordance with the present invention.

It is desirable to install a locking device 210 so as for the insertion plate 200 not to be spontaneously taken off out of the bracket 100. Only if it can selectively lock or unlock the insertion plate 200 at the bracket 100, there are no limitations on the locking device 210. For example, the locking device 210 can comprise a locking bar 212 installed in the insertion plate 200 with a hinge 211 to be seesawed; holes 213 and 214 formed in the insertion plate 200 and the bracket 100, respectively; a locking protrusion 216 formed in one end of the locking bar 212 and having a sloping surface 215, which is selectively inserted in the holes 213 and 214; a spring 217 installed between the other end of the locking bar 212 and the insertion plate 200, which presses the other end of the locking bar 212 upward to maintain the condition that the locking protrusion 216 is inserted in the holes 213 and 214; a housing 219 fixed to the insertion plate 200 with screws 218 and surrounding the locking bar 212; and a release button 220 installed in the housing 219, which presses the other end of the locking bar 212 downward and takes out the locking protrusion 216 out of the holes 213 and 214 when pushing it. In FIG. 3, reference numbers 221 and 222 indicate protrusions for maintaining the spring 217.

According to the locking device 210, the locking protrusion 216 is inserted into the holes 213 and 214 by elasticity of the spring 217 when the insertion plate 200 is inserted into the bracket 100, whereby the insertion plate 200 is fixed to the bracket 100 not to be spontaneously taken off. At this time, the locking protrusion 216 is naturally inserted into the holes 213 and 214 by the action of the sloping surface 215.

Meanwhile, the locking protrusion 216 is taken off from the holes 213 and 214 when the release button 220 is pushed, whereby the insertion plate 200 can be taken out from the bracket 100.

Each of the bearing parts 300 is installed in the insertion plates 200 and supports the leg parts 500, respectively. Each of the bearing parts 300 comprises a first bearing 310 and a pair of second bearings 320 located in both sides of the first bearing 310 at suitable intervals(T). The bearings 310 and 320 are assembled at the insertion plate 200 with screws 340.

The first bearing 310 has a shaft hole 311 where one end of the shaft 400 is rotatably inserted, and each of the second bearings 320 has a shaft hole 322 where the other end of the shaft 400 is rotatably inserted. Also, each of the second bearings 320 has two keeping grooves 323 at suitable angle intervals around the shaft hole 322 in the inside surface 321 thereof, more preferably has four keeping grooves 323 arranged in the shape of X at suitable angle intervals around the shaft hole 322 in the inside surface 321 thereof The keeping grooves 323 are formed in the positions corresponding to the locations of the leg parts 500 when the golf bag 1 is put on the ground and when the golf bag 1 is carried, that is, in the positions corresponding to the location that the leg parts 500 come into close contact to the golf bag 1 and to the location that the leg parts 500 are widen from the golf bag 1 at suitable angle intervals, as illustrated in the dotted line and the solid line in FIG. 1. The action of keeping grooves 323 will be in detail described hereinafter.

The shafts 400 are inserted between the first bearing 310 and each of the second bearings 320 to be moved from side to side. That is, one end of the shaft 400 is inserted in the shaft hole 311 of the first bearing 310 and the other end of the shaft 400 is inserted in the shaft hole 322 of the second bearing 320, whereby all the shafts 400 are rotatably supported by the first bearing 310 and the second bearings 320.

In the outer circumferences 410 of the respective shafts 400, at least one keeping protrusion 411 is formed, which is selectively inserted in the keeping grooves 323 of the second bearing 320. As illustrated in FIG. 2, when the four keeping grooves 323 are arranged in the shape of X in each of the second bearings 320, it is desirable that each of the shafts 400 has two keeping protrusions 411 located in the opposite positions across the center thereof, whereby the keeping protrusion 411*b* is inserted in the keeping groove 323*a*' opposite to the keeping groove 323*a* when the keeping protrusion 411*a* is inserted in the keeping groove 323*a*, and the keeping protrusion 411*b* is inserted in the keeping groove 323*b*' opposite to the keeping groove 323*b* when the keeping protrusion 411*a* is inserted in the keeping groove 323*b*. Therefore, the rotation of the shafts 400 about the first bearing 310 and the second bearings 320 is surely prevented.

The keeping protrusion 411 is inserted within the intervals (T) between the first bearing 310 and the second bearings 320. Therefore, when the shafts 400 are moved toward the first bearing 310 to bring the keeping protrusions 411 into contact with both side surface s 312 of the first bearing 310, all the keeping protrusions 411 are taken out from all the keeping grooves 323, so the shafts 400 can be freely rotated about the first bearing 310 and the second bearings 320. In short, depending on right and left movement of the shafts 400. the shafts 400 can be converted into conditions that they can be rotated or conditions that they cannot be rotated, It is desirable that the width(W) of the first bearing 310 is formed to receive the length of movement of the two shafts 400 when the shafts 400 are moved toward the first bearing 310 to have the keeping protrusions 411 taken out from the keeping grooves 323.

Also. it is desirable that a spring 420 is inserted through the shaft hole 311 of the first bearing 310 and both the ends of the spring 420 are inserted in hollows 430 which are formed in each of the shafts 400 in the direction of the first bearing 310, whereby the shafts 400 are pressed toward the second bearings 320 by the spring 420. By the action of the spring 420, the two shafts 400 receive a power given toward the second bearings 32)0. whereby the keeping protrusions 411 are spontaneously inserted in the keeping grooves 323 and the shafts 400 are not rotated when the keeping protrusions 411 reach the position of the keeping grooves 323 according to the rotation of shafts 400. It is desirable that the mouths of keeping grooves 323 are rounded off in order for the keeping protrusions 411 to be naturally inserted into the keeping grooves 323.

The leg part 500 having the wheel 510, more particularly a leg 520 whose upper part is a V-shape, is connected to each of the shafts 400. Preferably, as illustrated in FIG. 2, the upper end of the V-shaped leg 520 can be fixed to the keeping protrusions 411 by tightly inserting them into holes formed in the keeping protrusions 411 or by welding them to the keeping protrusions 411. The wheel 510 is a conventional wheel which can be rotated with enduring the weight of the golf bag I and golf clubs 3.

Only the V-shaped leg 520 having the wheel 510 can be used as the leg part 500; however, it is desirable that the leg part 500 further comprising a linear leg 530 and a link member 540 is used. That is, the wheel 510 is connected to the V-shaped leg 520 and the linear leg 530 through the medium of the link member 540 which is connected to the lower ends of the legs 520 and 530 with knuckle joints 541 and 542. The linear leg 530 has a hinge hole 531 in its upper end and it is pivotally connected to a third bearing 330 which is additionally installed in the insertion plate 200 in the lower part of the first bearing 310. Accordingly, by the structure of the leg part 500 consisting of the V-shaped leg 520 and the linear leg 530, the intensity of the leg part 500 supporting the golf bag 1 is improved.

Instead of employing the spring 420 by way of pressing the shaft 400 toward the second bearing 320, the V-shaped leg 520 can also be made up for the branched upper ends to be stretched out by giving elasticity to it, whereby a similar function to the spring 420 is realized without using the spring 420.

Hereinafter, the operation of the cart 10 in accordance with the present invention will be described referring to FIGS. 2, 4 and 5.

At first, by pressing the branched upper ends of the V-shaped legs 520 toward the inside, the keeping protrusions 41 1 of the shafts 400 are taken out from the keeping grooves 323 and the keeping protrusions 411 are located within the intervals(T) and then the V-shaped legs 520 are pivoted down a little. Subsequently, the V-shaped legs 520 are continuously pivoted down under the situation that the above pressing of the V-shaped legs 520 is released. According to the down pivot of the V-shaped legs 520, the shafts 400 are rotated counterclockwise and the rotation is progressed until the keeping protrusions 411 reach the keeping grooves 323*a* and 323*a*' for standing the golf bag 1 on the ground and the keeping protrusions 411 are inserted into the keeping grooves 323*a* and 323*a*' by the elasticity of spring 420 and the elasticity of V-shaped legs 520, whereby the leg parts 500 are fixed in a contact condition with the golf bag 1. Accordingly, the golf bag 1 can be stood on the ground by putting the base 5 of the golf bag 1 on the ground, as illustrated in FIGS. 1 (dotted line) and 4.

Figure 4:
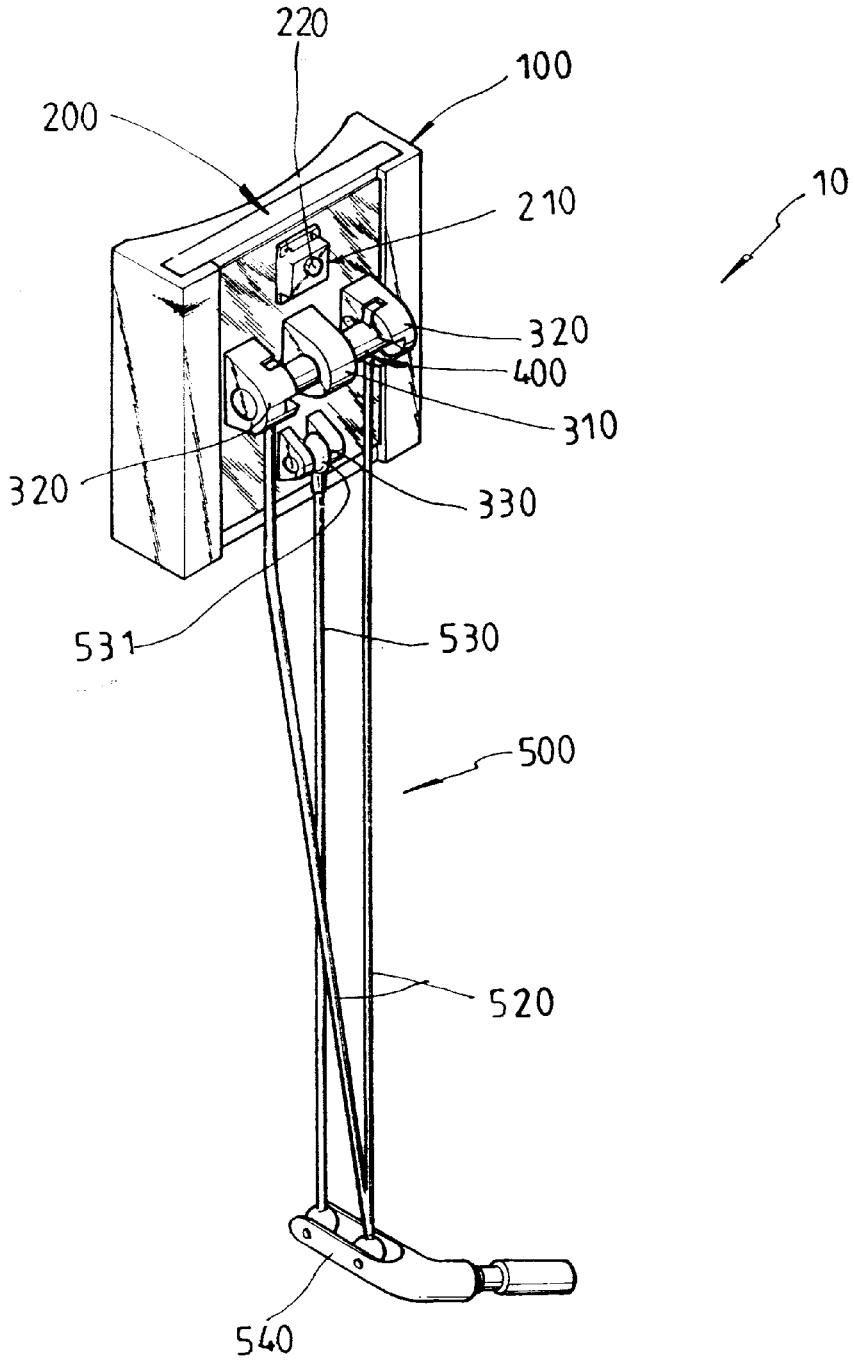
FIG. 4 is a perspective view of a cart in accordance with the present invention, showing the condition of the cart when a golf bag is carried.
Figure 5:
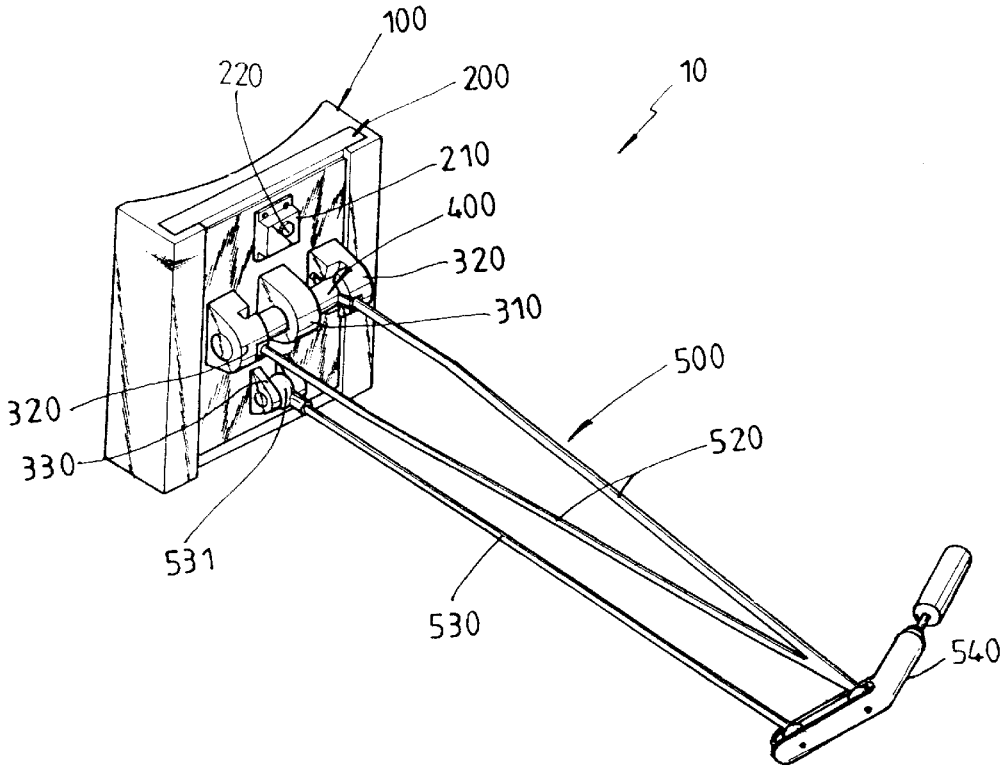
FIG. 5 is a perspective view of a cart in accordance with the present invention, showing the condition of the cart when a golf bag is put on the ground.

Next, by pressing the branched upper ends of the V-shaped legs 520 to the inside from the state illustrated in FIG. 4, the keeping protrusions 411 of the shafts 400 are taken out from the keeping grooves 323*a* and 323*a*' and they are located within the intervals(T) and then the V-shaped legs 520 are pivoted up a little. Subsequently, the V-shaped legs 520 are continuously pivoted up under the situation that the above pressing of the V-shaped legs 520 is released. According to the up pivot of the V-shaped legs 520, the shafts 400 are rotated clockwise and the rotation is progressed until the keeping protrusions 411 reach the keeping grooves 323*b* and 323*b*' for carrying the golf bag 1 and the keeping protrusions 411 are inserted into the keeping grooves 323*b* and 323*b*' by the elasticity of spring 420 and the elasticity of V-shaped legs 520, whereby the leg parts 500 are fixed in a condition widen from the golf bag 1. Accordingly, the golf bag 1 can be carried, as illustrated in FIGS. 1(solid line) and 4.

On the other hand, by pushing the release buttons 220 of the locking devices 210 and pulling the insertion plates 200 out of the brackets 100, all the parts of the cart 10 other than the brackets 100 can be separated from the golf bag 1, therefore, the cart 10 can be kept separately from the golf bag 1 when it is not used.

The reference number 600 in FIG. 1, is a handle part to use when carrying the golf bag 1 in the field. It is desirable that the angle of the handle part 600 can be rearranged according to the status of ground or the height of the player. Also, it is desirable that the handle part 600 can be separated from the golf bag 1, whereby the space which the handle part 600 occupies can be reduced when transporting or storing the golf bag 1.

As described above, in accordance with the present invention, the cart can be separated from the golf bag when it is not used and the angle of legs can be easily rearranged according to the standing state and the carrying state of the golf bag. Also, since the cart supports the inside periphery of the golf bag, the golf bag can be securely endured against its weight and can prevent the golf bag from being ripped by drooping down.

What is claimed is:

1. A detachable cart comprising: one or two brackets installed in a golf bag; a pair of insertion plates detachably installed in said bracket(s); a pair of bearing parts installed in each of said insertion plates, each of said bearing parts having a first bearing and two second bearings, said second bearings being located in both sides of said first bearing at suitable intervals and each having at least two keeping grooves in the circumference of shaft holes in the inside surfaces thereof, two pairs of shafts each having at least one keeping protrusion which is selectively inserted in said keeping grooves to limit the rotation of said shafts selectively, each of said shafts being rotatably supported between said first bearing and each of said second bearings; and a pair of leg parts each having a wheel and at least one V-shaped leg whose branched upper ends are pivotally connected to each of said shafts and whose lower ends are connected to said wheels.

2. A detachable cart as claimed in claim 1, wherein each of said bearing parts further comprises a third bearing installed in said insertion plates, each of said leg parts further comprises a linear leg whose upper end is pivotally connected to said third bearing, and said wheel is installed in the lower ends of said V-shaped leg and said linear leg through the medium of a link member.

3. A detachable cart as claimed in claim 1 further comprising a pair of locking devices which are each installed between said bracket and said insertion plate, and wherein said brackets each comprise a contact surface having the shape corresponding to the inside periphery of said golf bag, guide groove where said insertion plate is inserted and a stopper limiting the movement of said insertion plate.

4. A detachable cart as claimed in claim 1, wherein a hollow is formed in each of said shafts in the direction of said first bearing, and each of said bearing parts includes a spring inserted in said shaft hole of said first bearing and said hollows of said shafts.

5. A detachable cart as claimed in claim 1, wherein each of said second bearings has four keeping grooves arranged in the shape of X, and each of said shafts has two keeping protrusions located in the opposite position across the center of said shafts.

* * * * *

UNITED STATES PATENT AND TRADEMARK OFFICE

CERTIFICATE OF CORRECTION

PATENT NO. : 6,068,270

DATED : May 30, 2000

INVENTOR(S) : KIM, Jung Han

It is certified that error appears in the above-identified patent and that said Letters Patent are hereby corrected as shown below:

Assignee should read: King Tiger Corp., Seoul, Rep. of Korea

Signed and Sealed this

First Day of May, 2001

*Attest:*

Nicholas P. Godici

NICHOLAS P. GODICI

*Attesting Officer*

*Acting Director of the United States Patent and Trademark Office*